US008311452B2

(12) United States Patent
Kaneyama

(10) Patent No.: US 8,311,452 B2
(45) Date of Patent: Nov. 13, 2012

(54) TRANSFER DEVICE WITH CONTACT PRESSURE ADJUSTMENT MECHANISM AND IMAGE FORMING DEVICE USING THE SAME

(75) Inventor: Kiyotoshi Kaneyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 607 days.

(21) Appl. No.: 12/555,206

(22) Filed: Sep. 8, 2009

(65) Prior Publication Data

US 2010/0142997 A1 Jun. 10, 2010

(30) Foreign Application Priority Data

Dec. 8, 2008 (JP) ..... P2008-311912

(51) Int. Cl.
*G03G 15/16* (2006.01)

(52) U.S. Cl. ..... 399/121

(58) Field of Classification Search ..... 399/45, 399/66, 297, 302, 303, 308, 313, 121, 126
See application file for complete search history.

(56) References Cited

U.S. PATENT DOCUMENTS 3,627,523 A * 12/1971 Shelffo
3,848,204 A * 11/1974 Draugelis et al.

FOREIGN PATENT DOCUMENTS

JP 04-274271 9/1992
JP 06308842 A * 11/1994

* cited by examiner

*Primary Examiner* — Walter L Lindsay, Jr.
*Assistant Examiner* — Milton Gonzalez
(74) *Attorney, Agent, or Firm* — Morgan, Lewis & Bockius LLP

(57) ABSTRACT

A transfer device is provided and includes: a rotatable transfer roller; and a controller controls a balance of a pressure contact force exerted on the transfer roller in the axial direction, the controller including: a bearing member; a movable holding section that holds the bearing member; and a stationary holding section that holds the movable holding section. The movable holding section and the stationary holding section oppose each other by way of opposed surfaces, an adjustment unit is inserted into one of the opposed surfaces, and the movable holding section and the stationary holding section are arranged in such a manner that an extremity of the adjustment unit contacts the other of the opposed surfaces.

6 Claims, 8 Drawing Sheets

TRANSFER DEVICE WITH CONTACT PRESSURE ADJUSTMENT MECHANISM AND IMAGE FORMING DEVICE USING THE SAME

CROSS-REFERENCE TO RELATED APPLICATION

This application is based on and claims priority under 35 USC §119 from Japanese Patent Application No. 2008-311912 filed Dec. 8, 2008.

BACKGROUND (i) Technical Field

The present invention relates to a transfer device and an image forming apparatus equipped with the transfer device.

(ii) Related Art

A so-called image forming apparatus of intermediate transfer type has hitherto been known as a color image forming apparatus to which electrophotography is applied, such as a color copier and a color printer (see; for instance, Patent Document 1). The image forming apparatus of intermediate transfer type is built from a plurality of image forming units assigned to respective colors, such as yellow (Y), magenta (M), cyan (C), and black (K). Primary transfer devices disposed opposite the respective photosensitive drums temporarily, primarily transfer toner images in respective colors, which are sequentially formed on photosensitive drums of the respective image forming units, onto an intermediate transfer member in a superimposed manner. Subsequently, a second transfer device collectively transfers the toner images in respective colors, which have been transferred onto the intermediate transfer member in a superimposed manner, onto a recording medium through second transfer operation. The toner image undergoes heating and pressurization, to thus be fixed on a recording medium. A color image is thereby generated.

SUMMARY

According to an aspect of the present invention, there is provided a transfer device including:

a rotatable transfer roller capable coming into pressure contact with a belt-shaped intermediate transfer member; and a controller that is provided at an end of the transfer roller in an axial direction thereof and that controls a balance of a pressure contact force exerted on the transfer roller in the axial direction, the controller including: a bearing member that rotatably supports the end of the transfer roller in the axial direction; a movable holding section that holds the bearing member by way of an elastic member forced in a direction of pressure contact and is able to move along the direction of pressure contact; and a stationary holding section that has a guide section for guiding the movable holding section in the direction of pressure contact and that holds the movable holding section so as to be relatively movable, the movable holding section and the stationary holding section opposing each other by way of opposed surfaces that are orthogonal to the direction of pressure contact, an adjustment unit being inserted into one of the opposed surfaces, and the movable holding section and the stationary holding section being arranged in such a manner that an extremity of the adjustment unit contacts the other of the opposed surfaces.

BRIEF DESCRIPTION OF THE DRAWINGS

Exemplary embodiments of the present invention will be described in detail based on the following figures, wherein.

Figure 1:
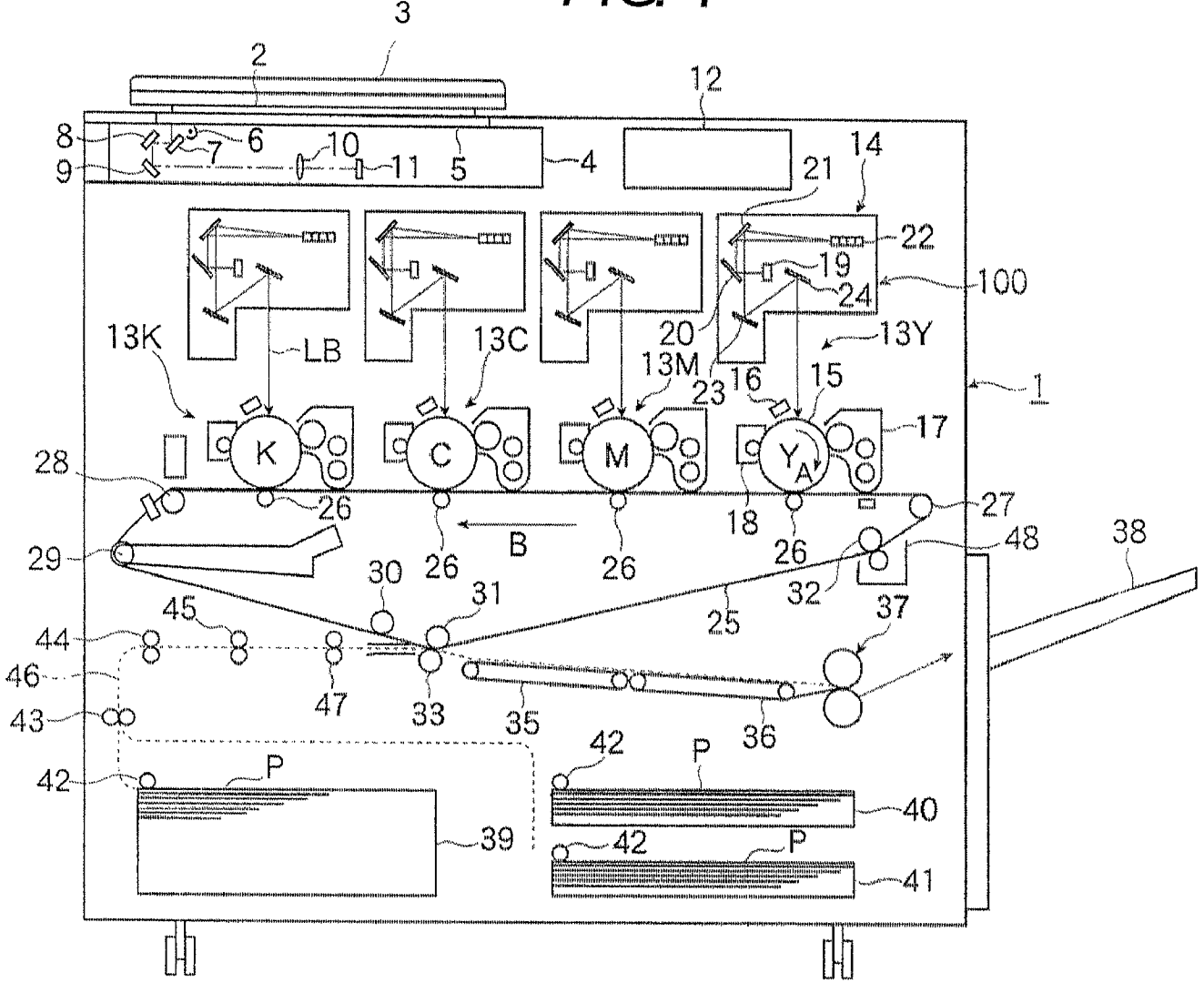
FIG. 1 is a schematic view showing a tandem type to which an exemplary embodiment of the present invention is applicable.

The followings are descriptions of some of the reference numerals and symbols in the drawings.

1: image forming apparatus, 13Y, 13M, 13C, 13K: image forming unit, 14Y, 14M, 14C, 14K: exposure unit, 15Y, 15M, 15C, 15K: photosensitive drum, 16Y, 16M, 16C, 16K: electrifier, 17Y, 17M, 17C, 17K: development unit, 18Y, 18M, 18C, 18K: drum cleaner, 25: intermediate transfer belt, 26Y, 26M, 26C, 26K: primary transfer unit, 31: backup roller, 33: secondary transfer roller; 37: fixing unit, 38: exit tray, 39, 40, 41: sheet tray, 48: belt cleaner, 150: photosensitive drum holding frame, 150*v*1, 150*v*2: recessed groove, 260: primary transfer roller, 260*a*: roller main unit, 260*s*: axial end, 270: pressure contact force balance control means, 270F: stationary holding section, 270Fg: guide, 270Fp: opposed portion, 270Fp0: opposed surface, 270M: movable holding section, 270Mg: groove, 270Mp: opposed portion, 270$Mp_0$: opposed surface, P: recording sheet, R1, R2: bearing member, S1, S2: coil spring, SR: screw thread, SW: adjustment screw

DETAILED DESCRIPTION

Exemplary embodiments of the present invention will be hereunder described by reference to the drawings.

First, the general configuration of an image forming apparatus to which an exemplary embodiment of the present invention is applicable will be described by reference to FIG. 1. FIG. 1 is a schematic view showing the general configuration of a color photographic copier of a tandem type to which an exemplary embodiment of the present invention is applicable. Although the color photographic copier of a tandem type has an image reader but may also be embodied, as an image forming apparatus, a color printer, a facsimile, and the like, that is not equipped with an image reader and that generates an image from image data output from an unillustrated personal computer, and the like.

In FIG. 1, reference numeral 1 designates a main unit of the color electrophotographic copier of a tandem type. An image reader (IIT: Image Input Terminal) 4 that reads an image of a document 2 is positioned in an upper portion at one end of the color electrophotographic copier main unit 1. The color electrophotographic copier main unit 1 houses an image processing system (IPS: Image Processing System) 12 that subjects image data output from the image reader 4, an unillustrated personal computer, and the like, or image data sent by a phone line, a LAN, or the like, to predetermined image processing, and an image output terminal (IOT: Image Output Terminal) 100 that output an image in accordance with image data subjected to predetermined image processing in the IPS 12.

The image reader 4 reads an image of the document 2 pressed on platen glass 5 by a platen cover 3 and an image of an original automatically conveyed by an unillustrated automatic document conveyor. The image reader 4 is configured in such a way that the document 2 placed on the platen glass 5 is illuminated with a light source 6. A reflected light image from the document 2 is subjected tp scan exposure by an image reading element 11 made up of a CCD, and the like, by way of a reduction optical system made up of a full rate mirror 7, half rate mirrors 8 and 9, and an imaging lens 10. The image reading element 11 reads a coloring material reflected light image of the document 2 at a predetermined dot density (e.g., 16 dots/mm).

The coloring material reflected light image of the document 2 read by the image reader 4 is sent to the IPS 12 as three colors; for instance, red (R), green (G), and blue (B) (each color has eight bits), of document reflectance data. The IPS 12 subjects the reflectance data pertaining to the document 2 to predetermined image processing, such as shading correction, positional displacement correction, brightness/color space conversion, gamma correction, the erasure of a frame, and color/movement edition.

As mentioned above, the image data subjected to predetermined image processing by the IPS 12 are converted into document coloring material halftone data (raster data) in four colors; yellow (Y), magenta (M), cyan (C), and black (K) (each color data has eight bits). As will be described below, the halftone data are sent to exposure units 14Y, 14M, 14C, and 14K of the image forming units 13Y, 13M, 13C, and 13K of respective yellow (Y), magenta (M), cyan (C), and black (K) colors. The exposure units 14Y, 14M, 14C, and 14K each perform image exposure by means of a laser beam LB in accordance with the document coloring material halftone data in predetermined colors.

As mentioned above, the four image forming units 13Y, 13M, 13C, and 13K for yellow (Y), magenta (M), cyan (C), and black (K), are arranged at a horizontal space side by side within the tandem-type color electrophotographic copier main unit 1.

All of the four image forming units 13Y, 13M, 13C, and 13K are similarly built. Each of the image forming units is roughly made up of a photosensitive drum 15 serving as an image holding member that is rotationally driven at predetermined speed in a direction of arrow A; a scorotoron 16 acting as electrification means that uniformly electrifies the surface of the photosensitive drum 15; an exposure unit 14 that subjects the surface of the photosensitive drum 15 to scan exposure of the laser beam commensurate with image information of each color, to thus form an electrostatic latent image; a development unit 17 that develops the electrostatic latent image made on the photosensitive drum 15; a drum cleaner 18 for eliminating transfer residual toner left on the surface of the photosensitive drum 15 after transfer operation.

The exposure unit 14 modulates a semiconductor laser 19 in accordance with the document coloring material half tone data and emits the laser beam LB from the semiconductor laser 19 in accordance with the halftone data. The laser beam LB exiting from the semiconductor laser 19 undergoes deflection scanning on a rotary polygon mirror 22 by way of reflection mirrors 20 and 21. The thus-scanned beam is again caused to effect scan exposure on the photosensitive drum 15 serving as an image holding member, by way of the reflection mirrors 20 and 21 and the plurality of reflection mirrors 23 and 24.

The IPS 12 sequentially outputs colors of image data (raster data) to the exposure units 14Y, 14M, 14C, and 14K of the image forming units 13Y, 13M, 13C, and 13K of yellow (Y), magenta (M), cyan (C), and black (K) colors. Surfaces of the respective photosensitive drums 15Y, 15M, 15C, and 15K are subjected to scan exposure by means of the laser beams LB exiting from the exposure units 14Y, 14M, 14C, and 14K in accordance with image data, whereby electrostatic latent images are made on the respective photosensitive drums. Electrostatic latent images made on the respective photosensitive drums 15Y, 15M, 15C, and 15K are developed as yellow (Y), magenta (M), cyan (C), and black (K) colors of toner images by the corresponding development units 17Y, 17M, 17C, and 17K.

Yellow (Y), magenta (M), cyan (C), and black (K) colors of unfixed toner images sequentially made on the respective photosensitive drums 15Y, 15M, 15C, and 15K of the image forming units 13Y, 13M, 13C, and 13K are sequentially transferred to the surface of an intermediate transfer belt 25 in a mutually-superimposed manner at a primary transfer position where the photosensitive drums 15Y, 15M, 15C, and 15K contact the intermediate transfer belt 25 working as an intermediate transfer member. Semiconductive primary transfer rollers 260Y, 260M, 260C, and 260K working as transfer members are disposed on the back of the intermediate transfer belt 25 achieved at the primary transfer position. The intermediate transfer belt 25 comes into contact with the surfaces of the photosensitive drums 15Y, 15M, 15C, and 15K by means of these primary transfer rollers 260Y, 260M, 260C, and 260K. A voltage whose polarity is opposite to the electrostatic polarity of toner is applied to the primary transfer rollers 260Y, 260M, 260C, and 260K. The respective colors of the unfixed toner images made on the respective photosensitive drums 15Y, 15M, 15C, and 15K are sequentially, electrostatically attracted onto the intermediate transfer belt 25, whereby a full-color image is made. Transfer residual toner on the surfaces of the photosensitive drums 15Y, 15M, 15C, and 15K is cleaned by drum cleaners 18Y, 18M, 18C, and 18K.

The intermediate transfer belt 25 is stretched in a state of given tension among a drive roller 27, a driven roller 28, a tension roller 29, a driven roller 30, a backup roller 31 acting as an opposed roller for secondary transfer purpose, and an idle roller 32. By means of the drive roller 27 that is rotationally driven by an unillustrated custom-designed drive motor exhibiting a superior constant speed characteristic, the intermediate transfer belt 25 is cyclically driven at predetermined speed in a direction of arrow B and in synchronism with rotations of the photosensitive drums 15Y, 15M, 15C, and 15K.

When a monochrome image is made, only a desired color of image forming unit in the image forming units 13Y, 13M, 13C, and 13K is activated, to thus form a desired monochrome unfixed toner image on the intermediate transfer belt 25.

Yellow (Y), magenta (M), cyan (C), and black (K) colors of the unfixed toner images primarily-transferred on the intermediate transfer belt 25 in a superimposed manner are conveyed to a secondary transfer position facing a conveyance path for a recording sheet P (a recording medium) in conjunction with rotation of the intermediate transfer belt 25. The unfixed toner images are secondarily transferred from the intermediate transfer belt 25 to a recording sheet P at the secondary transfer position. The recording sheet P is fed from any one of sheet trays 39, 40, and 41 by a feed roller 42; conveyed to a registration roller 47 by means of sheet conveyance path 46 having a plurality of conveyance rollers 43 and 44; and temporarily held stationary at the roller 47. Next, the registration roller 47 conveys the recording sheet P at predetermined timing, to thus become nipped between the secondary transfer roller 33 and the intermediate transfer belt 25. The backup roller 31 opposing the secondary transfer roller 33 and an unillustrated metal roller contacting the backup roller 31 are disposed on the back of the intermediate transfer belt 25 achieved at the secondary transfer position. A voltage whose polarity is identical with electrostatic polarity of toner (i.e., a normal transfer bias) is applied to the metal roller at the secondary transfer position, whereby a transfer field is generated while the secondary transfer roller 33 is taken as a counter electrode. The unfixed toner image held on the intermediate transfer belt 25 is electrostatically transferred to the recording sheet P at the secondary transfer position. The secondary transfer roller 33 is cleaned with an unillustrated brush roller.

The recording sheet P on which the unfixed toner image is transferred is peeled off from the intermediate transfer belt 25; subsequently delivered to a fixing unit 37 by means of sheet conveyance belts 35 and 36 acting as twin transfer material conveyance means, where the recording sheet undergoes processing for fixing the unfixed toner image; and exits to an exit tray 38 disposed outside the main unit 1. The intermediate transfer belt 25 having finished secondarily transferring the unfixed toner image undergoes removal of residual toner by a belt cleaner 48 located downstream of the secondary transfer section.

Figure 2:
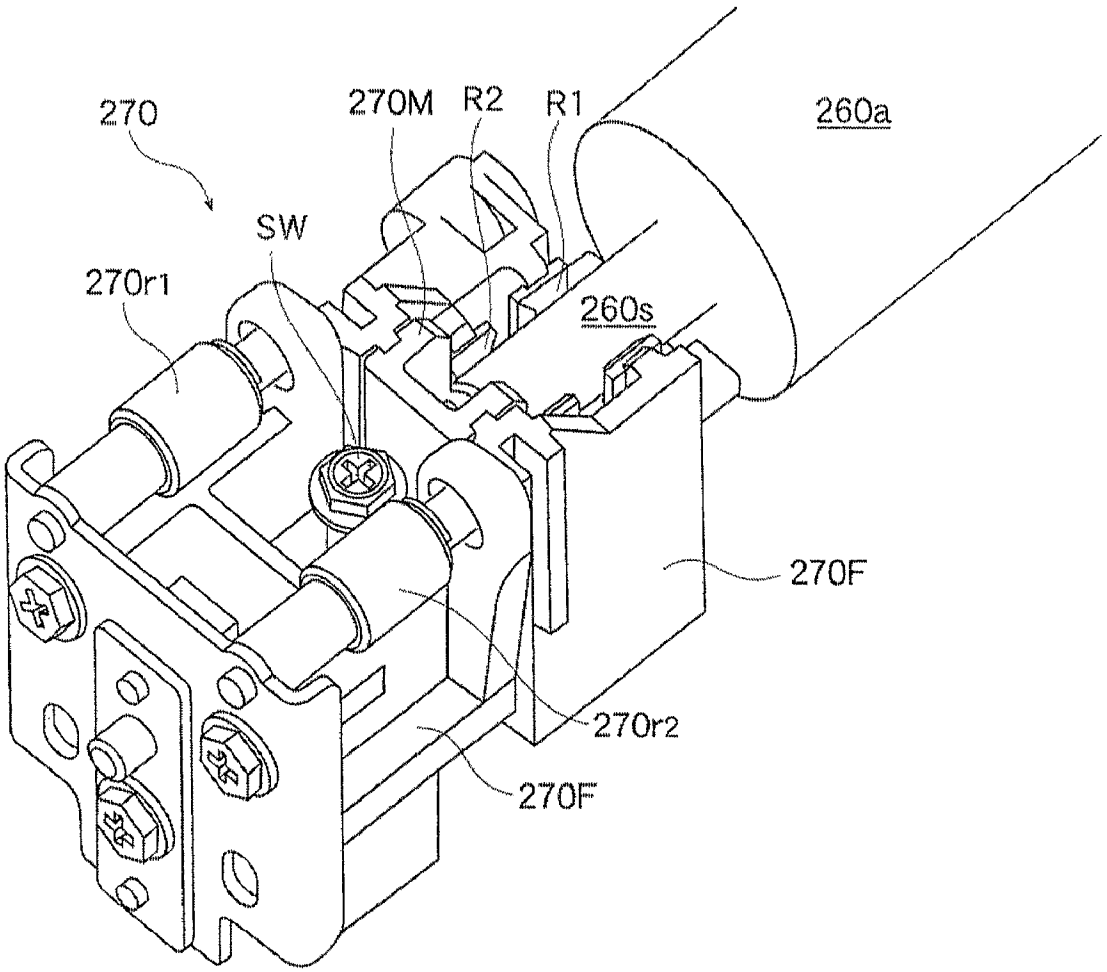
FIG. 2 is a schematic perspective view for describing the structure of one-end side of a transfer device of the exemplary embodiment.
Figure 3:
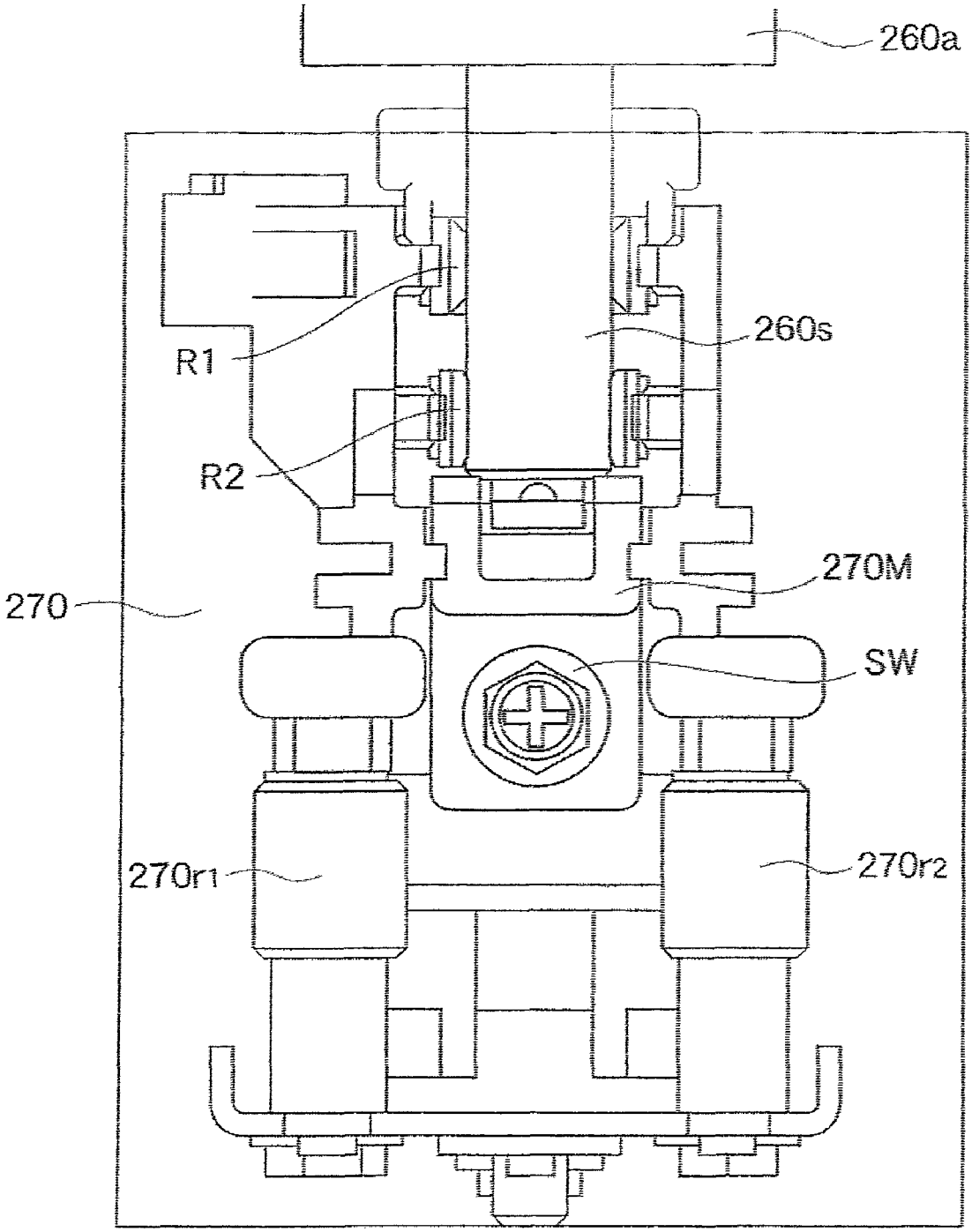
FIG. 3 is a schematic plan view for describing the structure of one-end side of the transfer device of the exemplary embodiment.
Figure 4:
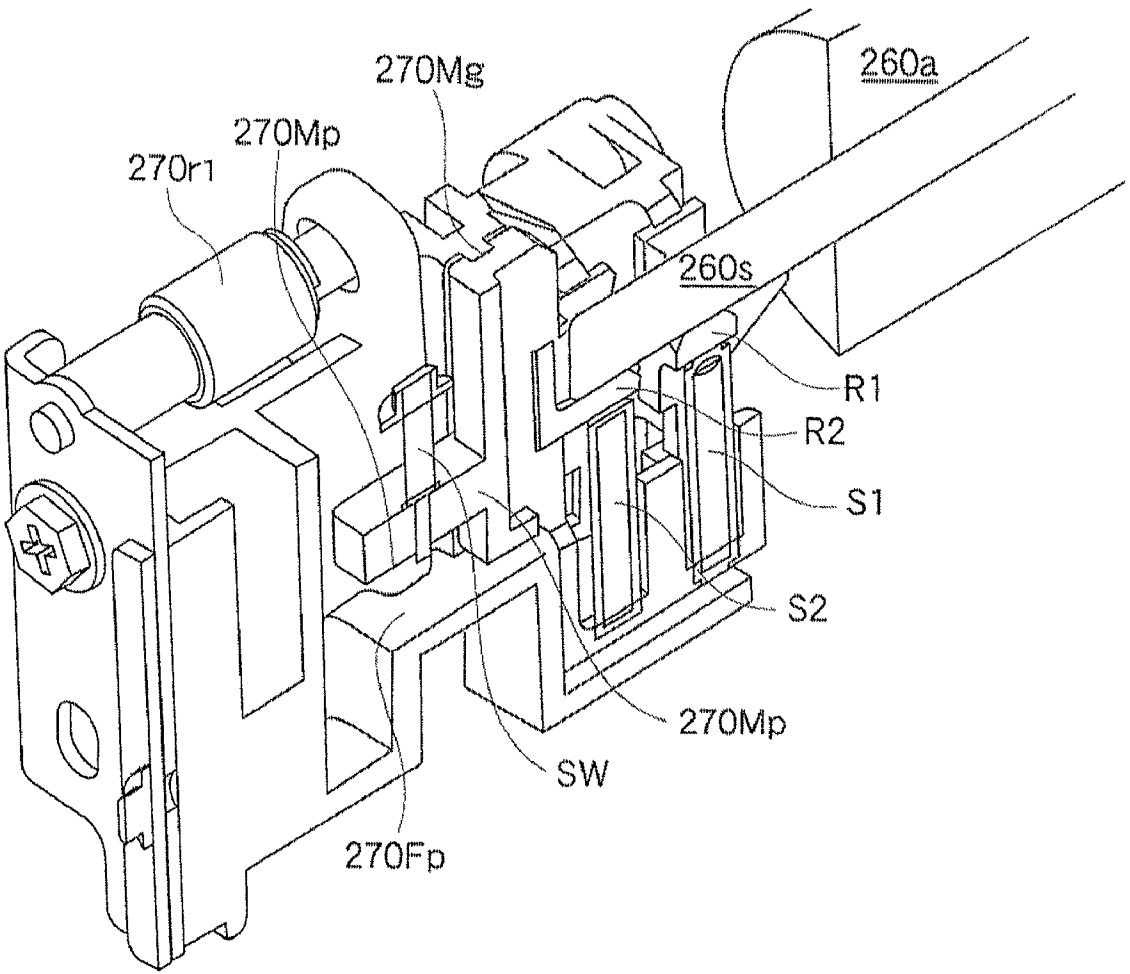
FIG. 4 is a schematic perspective view cut along a vertical view passing through a center axis of the primary transfer roller for describing the structure of the one-end side of the transfer device of the exemplary embodiment.
Figure 5:
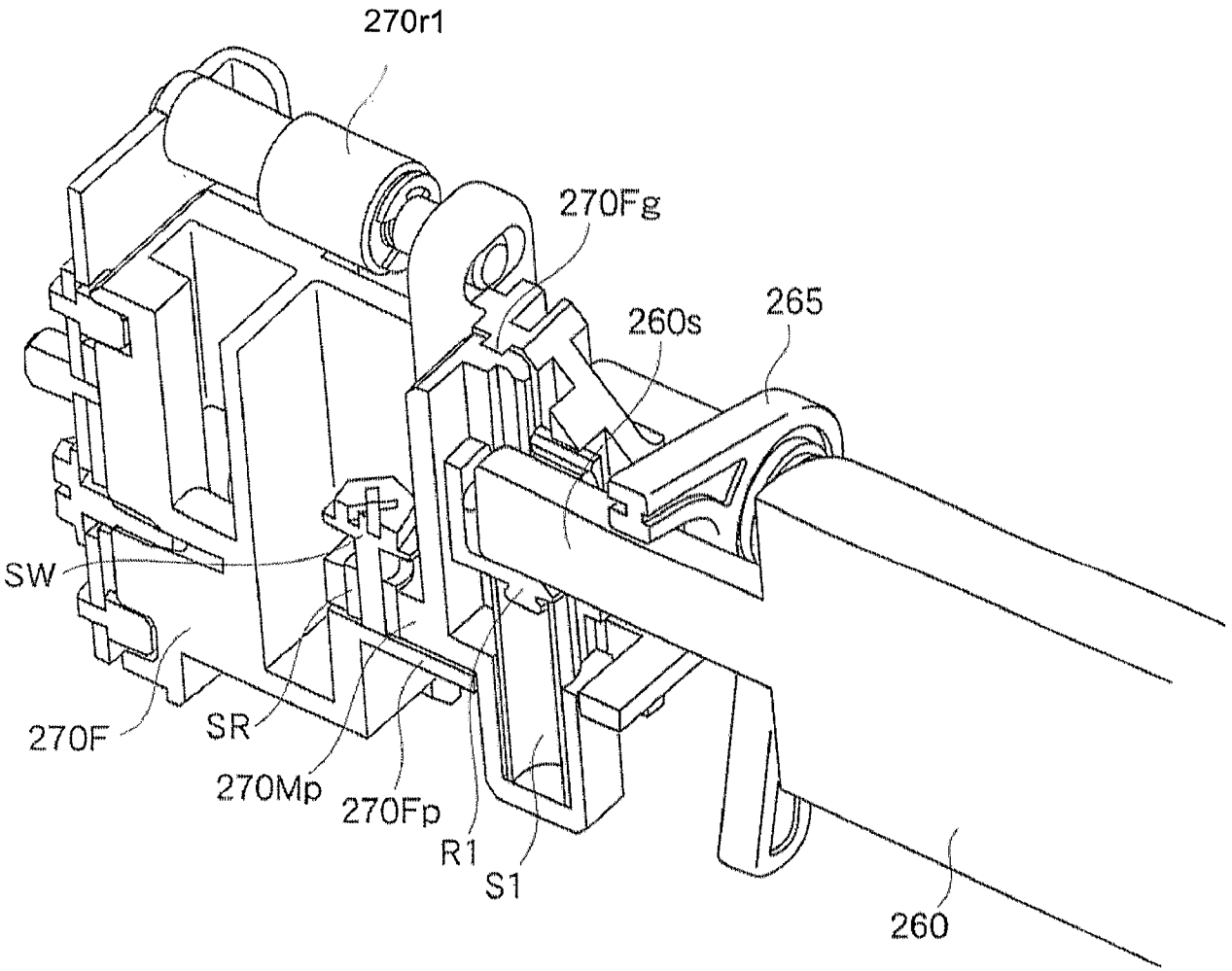
FIG. 5 is a schematic perspective view cut along a vertical view passing through a center axis of the primary transfer roller for describing the structure of the one-end side of the transfer device of the exemplary embodiment.
Figure 6:
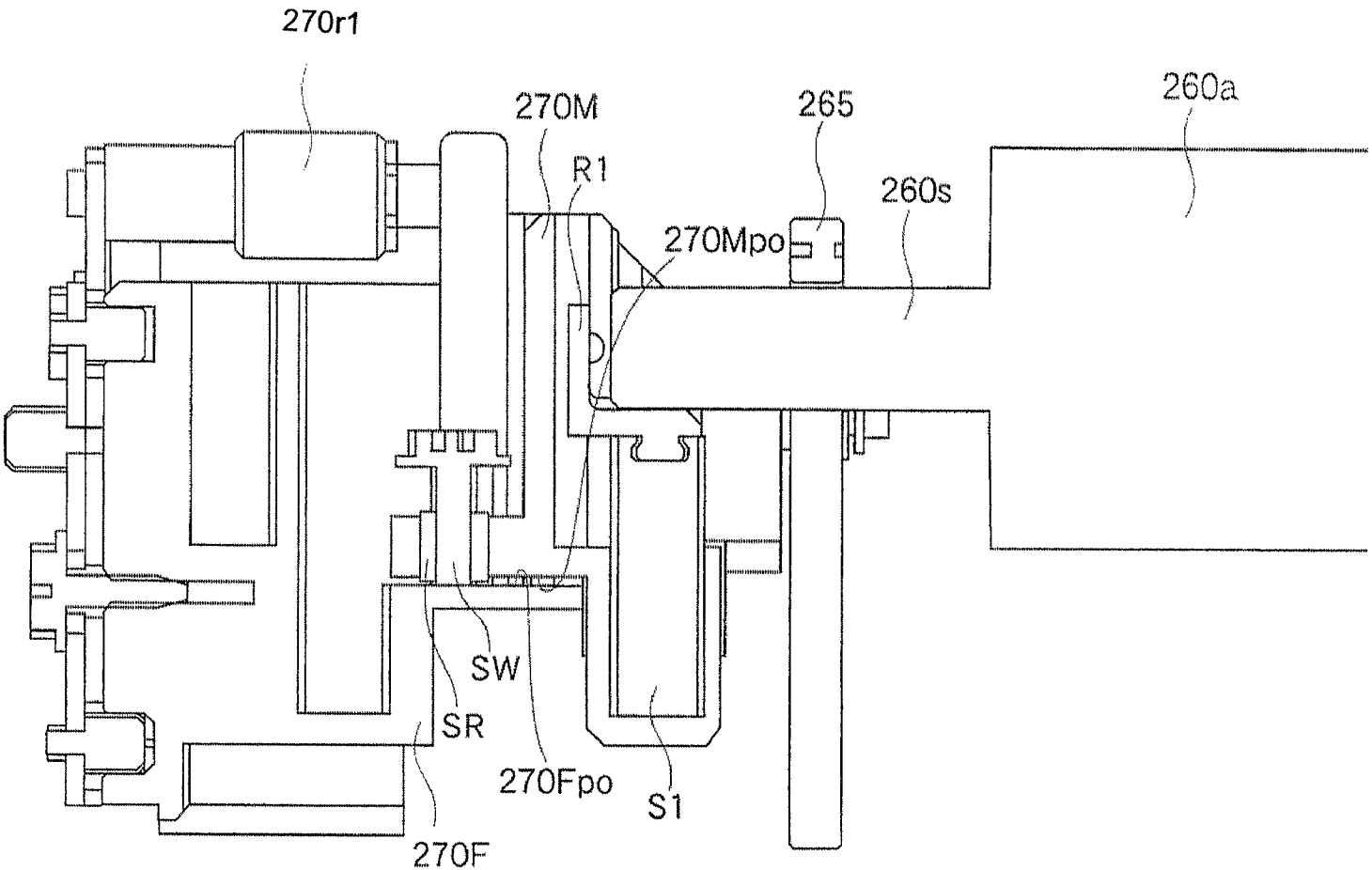
FIG. 6 is a schematic side cross-sectional view cut along a vertical view passing through the center axis of the primary transfer roller for describing the structure of the one-end side of the transfer device of the exemplary embodiment.
Figure 7:
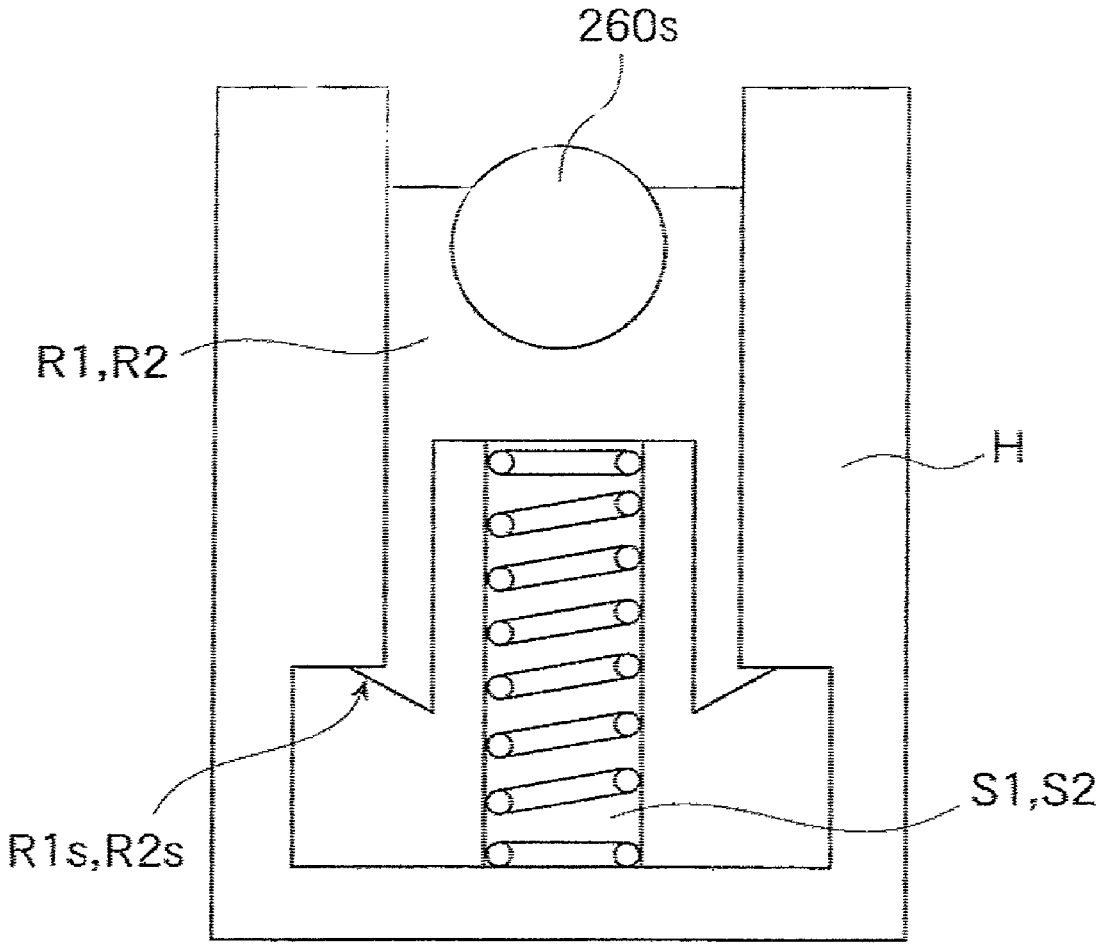
FIG. 7 is a schematic view for describing the structure of the other-end side of the transfer device of the exemplary embodiment of the present invention.
Figure 8:
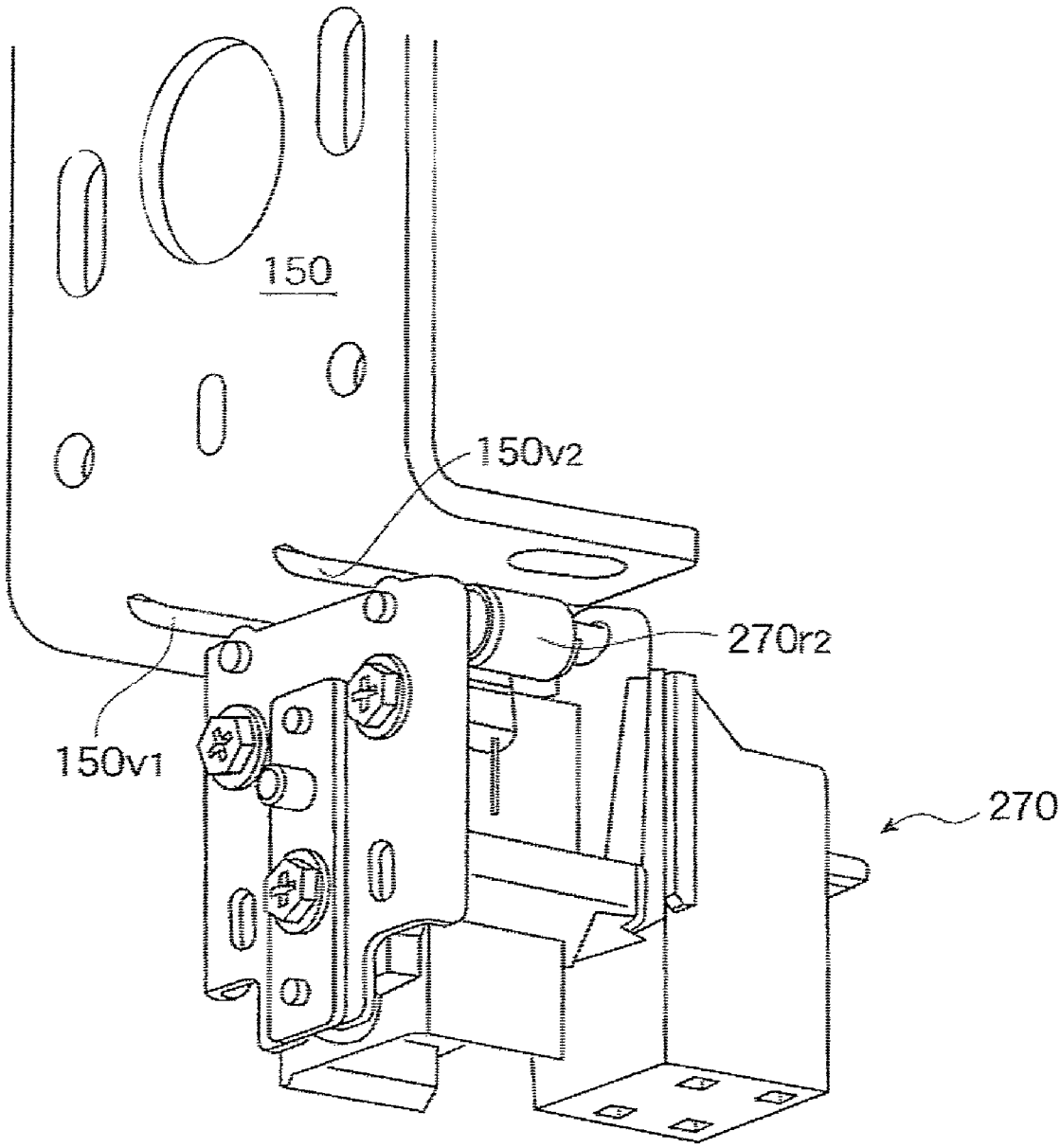
FIG. 8 is a schematic perspective view for describing the structure of a positioning member of the exemplary embodiment.

Details of the primary transfer devices 26Y, 26M, 26C, and 26K of the embodiment will be further described by reference to FIGS. 2 through 8. FIG. 2 is a schematic perspective view for describing the structure of one-end side of the transfer device of the embodiment; and FIG. 3 is a schematic plan view for describing the structure of one-end side of the transfer device of the embodiment. FIGS. 4 and 5 are schematic perspective views cut along a vertical view passing through a center axis of the primary transfer roller for describing the structure of the one-end side of the transfer device of the embodiment. FIG. 6 is a schematic side cross-sectional view cut along a vertical view passing through the center axis of the primary transfer roller for describing the structure of the one-end side of the transfer device of the embodiment. FIG. 7 is a schematic view for describing the structure of the other-end side of the transfer device of the embodiment, and FIG. 8 is a schematic perspective view for describing the structure of a positioning member of the embodiment. Since the primary transfer devices 26Y, 26M, 26C, and 26K and their constituent members have similar structures, reference numerals are hereinbelow, collectively designated (as; for instance, the primary transfer device 26) for the sake of brevity.

As shown in FIGS. 2 through 6, the primary transfer device 26 of the embodiment has a rotatable primary transfer roller 260 disposed opposite the photosensitive drum 15 with the intermediate transfer belt 25 interposed therebetween; contact pressure balance control means 270 that is to be described in detail later and that controls an axial balance of contact pressure on the primary transfer roller 260; an unillustrated primary transfer bias power source that applies a predetermined bias current to the primary transfer roller 260; and the like. The primary transfer device applies a primary transfer bias to the primary transfer roller 260 and brings the primary transfer roller 260 into pressure contact with the intermediate transfer belt 25, whereupon a toner image (a developing-agent image) made on the photosensitive drum 15 is primarily transferred to the intermediate transfer belt 25 by means of pressure contact force and electrostatic force.

The primary transfer roller 260 of the embodiment has a cylindrical roller main body 260*a* that is disposed opposite the photosensitive drum 15 with the intermediate transfer belt 25 sandwiched therebetween and that constitutes a primary transfer section; and axial ends 260*s* projecting outwardly from both ends of the roller main body 260*a* in its axial direction along the center axis. Each of the axial ends 260*s* is made so as to have a diameter which is smaller than an outer diameter of the roller main body 260*a*. Both axial ends 260*s* are rotatably supported by bearing members R, each of which has a recessed cross-sectional profile, by way of coil springs S acting as elastic members. Further, predetermined pressure contact force is imparted to the primary transfer roller 260 by means of the coil springs S.

Incidentally, in the thus-configured primary transfer device 26, an imbalance may arise in axial pressure contact force for reasons of age deterioration (deterioration over time) in constituent members; for instance, the primary transfer roller 260, the intermediate transfer belt 25, and the bearing member R. If such an imbalance has occurred, the imbalance will be a cause of an imperfection in an image, such as uneven axial transfer.

Accordingly, the primary transfer device 26 of the embodiment is equipped with the pressure contact force balance control means 270, such as that will be described below, which enables control of an axial balance of pressure contact force by means of a simple configuration.

The pressure contact force balance control means 270 of the embodiment has, at one axial end 260*s* of the primary transfer roller 260 (on the front of the image forming apparatus 1 having an unillustrated maintenance open door in the embodiment), bearing members R1 and R2 (see FIGS. 2 to 4) disposed side by side in the axial direction; a movable holding section 270M built so as to hold the bearing members R1 and R2 by way of elastic members S1 and S2 and be able to move along the direction of pressure contact; and a stationary holding section 270F that has a guide portion 270Mg for guiding the movable holding section 270M along the direction of pressure contact and that holds the movable holding section 270M in a relatively-movable manner.

Specifically, as best shown in FIGS. 2 through 4, the movable holding section 270M is a hollow-block-shaped (box-shaped) member that accommodates and holds the bearing members R1 and R2 axially disposed side by side. Coil springs S1 and S2 are interposed between bottoms of the bearing members R1 and R2 and a bottom of the movable holding section 270M disposed opposite the bottoms of the bearing members R1 and R2. The coil springs S1 and S2 bring the axial end 260*s* into pressure contact with the intermediate transfer belt 25 by way of the corresponding bearing members R1 and R2. Moreover, a pair of recessed grooves 270Mg extending in the direction of pressure contact are made in a side surface of the movable holding section 270M located axially outside the bearing members R1 and R2.

Like bearing members R1 and R2 are disposed, by way of like coil springs S1 and S2, on the other end 260*s* of the primary transfer roller 260 in its axial direction. Specifically, as diagrammatically shown in FIG. 7, the bearing members R1 and R2, each of which has a substantially-recessed cross-sectional profile, rotatably support the other end 260*s* in the axial direction. The primary transfer roller 260 is brought into pressure contact with the photosensitive drum 15 by way of the coil springs S1 and S2 interposed between the bottoms of the bearing members R1 and R2 and a bottom of the stationary holding section H opposing the bottoms. The bearing members R1 and R2 are made so as to be slidable over right and left side surfaces of the stationary holding section H. Pawls R1*s* and R2*s* that latch the stationary holding section H are made on the corresponding bottoms of the bearing members R1 and R2, thereby regulating an upper limit for movements of the bearing members R1 and R2.

Accordingly, the primary transfer roller 260 of the embodiment is built in such a way that the coil springs S1 and S2 disposed at both axial ends 260*s* bring the primary transfer roller 260 into pressure contact with the photosensitive drum 15 by way of the intermediate transfer belt 25. The number of coil springs S to be arranged can be arbitrarily set, as required. FIGS. 2 through 4 show an example configuration in which two rows of coil springs S1 and S2 are arranged on one side in the axial direction. For the sake of convenience, FIGS. 5 and 6 show an example configuration in which one row of coil spring S1 is arranged on one side. In FIGS. 5 and 6, reference numeral 265 designates a portion of a known related-art retraction mechanism that brings the primary transfer roller 260 apart from the intermediate transfer belt 25.

Meanwhile, the stationary holding section 270F of the embodiment is adjacently arranged outside of the movable holding section 270M in its axial direction such that the movable holding section 270M is sandwiched between elements of the stationary holding section 270F. The stationary holding section 270F has a pair of projecting guide sections (guides) 270Fg that are fitted to a pair of recessed grooves 270Mg of the movable holding section 270M. Specifically, in the present embodiment, the stationary holding section 270F holds the movable holding section 270M in such a way that the movable holding section is held in a sandwiched manner by way of the pair of mutually-fitting grooves 270Mg and the pair of guide portions 270Fg. The movable holding section 270M is configured so as to be able to move relatively to the stationary holding section 270F in the direction of pressure contact (i.e., a vertical direction of the embodiment) along the guide portions 270Fg. The bearing members R1 and R2 have at their bottoms unillustrated pawls analogous to the pawls R1*s* and R2*s* disposed at the other end in the axial direction. The pawls engage with the stationary holding section 270F, thereby regulating movements of the bearing members R1 and R2 (see FIG. 7).

The movable holding section 270M has an opposed portion 270Mp, and the stationary holding section 270F has an opposed portion 270Fp, wherein the opposed portions 270Mp and 270Fp oppose each other by means of opposed surfaces 270$Mp_0$ and 270$Fp_0$, which are orthogonal to each other with respect to the direction of pressure contact, at a position outside of the guide portion 270Fg in its axial direction. A thread groove (a female thread) SR is made in the opposed portion 270Mp on the movable holding section 270M and in an extension of the center axis of the primary transfer roller 260.

Specifically, as best shown in FIGS. 5 and 6, the thread groove SR is made in correspondence with the center axis of the primary transfer roller 260 so as to become parallel to the coil springs S1 and S2. Adjustment screws (male screws) SW are inserted (upright) into the thread groove SR in parallel with the coil springs S1 and S2 and along the direction of pressure contact. Specifically, the opposed portion 270Mp of the movable holding section 270M and the opposed portion 270Fp of the stationary holding section 270F oppose each other by way of the opposed surfaces 270$Mp_0$ and 270$Fp_0$ that are orthogonal to the direction of contact pressure. The movable holding section 270M and the stationary holding section 270F are arranged opposite each other in such a way that an extremity of the adjustment screw SW inserted into the opposed portion 270Mp of the movable holding section 270M contacts the opposed surface 270$Fp_0$ of the stationary holding section 270F. As a result, the movable holding section 270M is movable relatively to the stationary holding section 270F in the direction of pressure contact in association with rotation of the adjustment screw SW.

As mentioned above, there are provided the movable holding section 270M that holds the bearing member R by way of an elastic member S and the stationary holding section 270F that further holds the movable holding section 270M in a relatively movable manner. The movable holding section 270M and the stationary holding section 270F, which constitute a double structure, are connected together by means of the adjustment screw SW, whereby the stroke of the coil springs S can be finely changed by rotation of the adjustment screw SW. A balance of pressure-contact force achieved in the entirety of the primary transfer device in its axial direction can be readily adjusted with high accuracy and only at one axial end. A balance of the pressure-contact force exerted on the primary transfer roller 260 in its axial direction can be adjusted while a balance of the primary transfer roller 260 in its radial direction is maintained, by means of positioning the adjustment screw SW in correspondence with the center axis of the primary transfer roller 260 (i.e., an extension of the center axis).

In an initial state, the primary transfer device 26 of the present embodiment is adjusted in such a way that the pressure-contact force achieved in the axial direction becomes uniform in a state where an upper surface of the groove portion 270Mg of the movable holding section 270M and an upper surface of the guide portion 270Fg of the stationary holding section 270F become flush with each other. Further, from the viewpoint of enabling adjustment of pressure-contact force in either an increment direction and a decrement direction at the time of maintenance operation, the movable holding section 270M and the stationary holding section 270F are previously arranged opposite each other, in an initial state, with clearance between the opposed surfaces 270$Mp_0$ and 270$Fp_0$.

From the viewpoint of enhancement of workability at the time of maintenance operation, the pressure contact force balance adjustment means 270 of the embodiment is preferably provided at one end 260*s*, in its axial direction, of the unillustrated maintenance open door.

In the embodiment, the adjustment screw SW is provided in the movable holding section 270M and configured such that the extremity of the adjustment screw contacts the opposed surface 270$Fp_0$ of the stationary holding section 270F. As a matter of course, the adjustment screw SW can also be provided in the stationary holding section 270F and configured such that the extremity of the adjustment screw contacts the opposed surface 270$Mp_0$ of the movable holding section 270M.

Moreover, a pair of rolled positioning members 270$r_1$ and 270$r_2$ are disposed in an upper portion of the stationary holding section 270F of the embodiment and at positions outside the stationary holding section 270F in its axial direction. The pair of rolled positioning members 270$r_1$ and 270$r_2$ are rotatably provided, in parallel with the primary transfer roller 260, at positions that are symmetrical about the center axis of the primary transfer roller 260. As diagrammatically shown in FIG. 8, a pair of substantially-V-shaped recessed grooves 150$v_1$ and 150$v_2$ positioned along the axial direction are provided on a bottom of the end of a photosensitive drum holding frame 150 in its axial direction, where the photosensitive drum 15 is mounted. The pair of recessed grooves 150$v_1$ and 150$v_2$ are made so as to engage with a pair of rolled positioning members 270$d$ $r_1$ and 270$r_2$ provided on the primary transfer roller 260. Thus, it becomes possible to appropriately position the primary transfer roller 260 directly with respect to the photosensitive drum 15 without involvement of the intermediate transfer belt 25, thereby preventing occurrence of image imperfections, which would otherwise be caused by deterioration of positional accuracy between the photosensitive drum 15 and the primary transfer roller 260.

In the thus-configured primary transfer device 26 of the embodiment, for instance, in a case where output of a sample image or measurement of pressure contact force is performed during maintenance inspection, when uneven density is determined to arise in an axial direction or when an axial balance of pressure contact force is determined to be lost, the adjustment screw SW making up the pressure contact force balance control means 270 is rotated, thereby finely moving the movable holding section 270M in the direction of pressure contact, to thus finely adjust stroke of the coil spring S and easily adjust pressure contact force in the axial direction by means of a simple configuration.

Although the foregoing embodiment illustrates the configuration in which the pressure contact force balance control means 270 is provided at one axial end 260$s$ of the primary transfer roller 260, the present invention is not limited to such a configuration. As a matter of course, similar pressure contact force balance control means 270 can also be provided at both ends 260$s$ of the primary transfer roller 260 in its axial direction. Further, the pressure contact force balance control means 270 having a similar structure can also be provided on the secondary transfer roller 33 constituting the secondary transfer device as well as on the primary transfer device 26.

What is claimed is:

1. A transfer device comprising:

a rotatable transfer roller capable coming into pressure contact with a belt-shaped intermediate transfer member; and a controller that is provided at an end of the transfer roller in an axial direction thereof and that controls a balance of a pressure contact force exerted on the transfer roller in the axial direction, the controller including: a bearing member that rotatably supports the end of the transfer roller in the axial direction; a movable holding section that holds the bearing member by way of an elastic member forced in a direction of pressure contact and is able to move along the direction of pressure contact; and a stationary holding section that has a guide section for guiding the movable holding section in the direction of pressure contact and that holds the movable holding section so as to be relatively movable, the movable holding section and the stationary holding section opposing each other by way of opposed surfaces that are orthogonal to the direction of pressure contact, an adjustment unit being inserted into one of the opposed surfaces, and the movable holding section and the stationary holding section being arranged in such a manner that an extremity of the adjustment unit contacts the other of the opposed surfaces.

2. The transfer device according to claim 1, wherein the controller is provided only at one end of the transfer roller in the axial direction, and the opposed surfaces of the movable holding section and the stationary holding section are arranged, in an initial state, opposite each other with a space therebetween.

3. The transfer device according to claim 1, wherein the stationary holding section is adjacently arranged outside of the movable holding section in the axial direction of the transfer roller, and the adjustment unit is inserted into the one of the opposed surfaces in correspondence with a center axis of the transfer roller and in parallel with the elastic member.

4. The transfer device according to claim 1, wherein the controller is provided at an axial end on a front of the transfer device.

5. The transfer device according to claim 1, wherein the stationary holding section further includes a positioning member that performs positioning operation with respect to an image carrier on a surface of which a toner image to be transferred to the belt-shaped intermediate transfer member is made.

6. An image forming apparatus comprising:

a transfer device comprising:

a rotatable transfer roller capable coming into pressure contact with a belt-shaped intermediate transfer member; and a controller that is provided at an end of the transfer roller in an axial direction thereof and that controls a balance of a pressure contact force exerted on the transfer roller in the axial direction, the controller including: a bearing member that rotatably supports the end of the transfer roller in the axial direction; a movable holding section that holds the bearing member by way of an elastic member forced in a direction of pressure contact and is able to move along the direction of pressure contact; and a stationary holding section that has a guide section for guiding the movable holding section in the direction of pressure contact and that holds the movable holding section so as to be relatively movable, the movable holding section and the stationary holding section opposing each other by way of opposed surfaces that are orthogonal to the direction of pressure contact, an adjustment unit being inserted into one of the opposed surfaces, and the movable holding section and the stationary holding section being arranged in such a manner that an extremity of the adjustment unit contacts the other of the opposed surfaces; and an image forming unit that forms an image on a recording medium.

* * * * *